US007040973B1

(12) United States Patent
Kitts

(10) Patent No.: US 7,040,973 B1
(45) Date of Patent: May 9, 2006

(54) ABRASIVE SHEET

(76) Inventor: William Kitts, 1271 Chaucer, Troy, MI (US) 48083

( * ) Notice: Subject to any disclaimer, the term of this patent is extended or adjusted under 35 U.S.C. 154(b) by 0 days.

(21) Appl. No.: 10/936,860

(22) Filed: Sep. 9, 2004

Related U.S. Application Data

(60) Provisional application No. 60/501,805, filed on Sep. 10, 2003.

(51) Int. Cl.
*B24D 15/04* (2006.01)

(52) U.S. Cl. ..... 451/533; 451/524

(58) Field of Classification Search ..... 451/523, 451/524, 525, 357, 533
See application file for complete search history.

(56) References Cited

U.S. PATENT DOCUMENTS

| | | | | |
|---|---|---|---|---|
| 1,145,134 | A * | 7/1915 | Fowler | 451/522 |
| 1,455,559 | A * | 5/1923 | Wright et al. | 451/522 |
| 2,417,356 | A * | 3/1947 | Feild | 451/521 |
| 2,662,353 | A * | 12/1953 | Bergman et al. | 451/494 |
| 4,038,046 | A | 7/1977 | Supkis | |
| 4,459,987 | A | 7/1984 | Pangburn | |
| 4,534,138 | A | 8/1985 | Pangburn | |
| 4,581,287 | A | 4/1986 | Smith et al. | |
| 4,621,465 | A | 11/1986 | Pangburn | |
| 4,712,552 | A | 12/1987 | Pangburn | |
| 4,791,694 | A * | 12/1988 | Itaya et al. | 15/97.1 |
| 4,937,984 | A * | 7/1990 | Taranto | 451/524 |
| 5,287,863 | A | 2/1994 | La Joie et al. | |
| 5,309,681 | A * | 5/1994 | Cheney et al. | 451/344 |
| 5,551,961 | A | 9/1996 | Engen et al. | |
| 5,666,981 | A | 9/1997 | Stephens | |
| 5,882,776 | A | 3/1999 | Bambara et al. | |
| 6,167,790 | B1 | 1/2001 | Bambara et al. | |
| 6,547,643 | B1 * | 4/2003 | Miller et al. | 451/28 |
| 2001/0000568 | A1 | 5/2001 | Bambara et al. | |
| 2002/0098789 | A1 | 7/2002 | Burke | |
| 2002/0102924 | A1 | 8/2002 | Obeng et al. | |
| 2003/0021980 | A1 | 1/2003 | Obeng et al. | |
| 2003/0035940 | A1 | 2/2003 | Obeng et al. | |

OTHER PUBLICATIONS

Black rubber sanding block by Allway Tools, Inc. including photograph of block and packaging (2 pages).
Sandblaster sanding sponge by 3M including photograph of product and packaging (copyright 3M 2001) (2 pages).
Small area sanding sponge by Norton including photograph of product and packaging (copyright 2000) (2 pages).

* cited by examiner

*Primary Examiner*—Robert A. Rose
(74) *Attorney, Agent, or Firm*—Young & Basile, P.C.

(57) ABSTRACT

An abrasive sheet is made from an abrasive media mounted to a polymeric foam support member forming a one-piece abrasive sheet that is easily cut into any desirable configuration. The abrasive sheet is easily mounted to a holder adaptable to hand-held manual or powered tools.

1 Claim, 5 Drawing Sheets

ABRASIVE SHEET

CROSS-REFERENCE TO RELATED APPLICATIONS

This application claims the benefit of the provisional patent application 60/501,805 for ABRASIVE SHEET, filed on Sep. 10, 2003. This claim is made under 35 U.S.C. §119(e); 37 C.F.R. § 1.78; and 65 FR 50093.

FIELD OF THE INVENTION

The present invention relates to an Abrasive Sheet apparatus for sanding or polishing materials and surfaces.

BACKGROUND

Abrasive sandpaper and other sheet materials for sanding, polishing and otherwise removing a layer of material are known in the art. Sandpaper of various grits and backing materials are commonly used across manufacturing fields on almost all materials from sanding wood to polishing clear coat paints. Sandpaper is commonly manufactured on paper backing which is easily cut, torn or folded back onto itself to achieve the desired shape or configuration suitable for the application. Any user of sandpaper knows the difficulty in using sandpaper as its thin, flimsy paper backing easily folds back on itself in use and tears rather easily. The paper backing of common sandpaper may also be coated to resist absorption of water or moisture which would otherwise allow the sandpaper to be too easily torn on application of force to remove material. Water resistant sandpaper nonetheless will roll-up or curl on prolonged exposure to moisture making it difficult to use for extended periods of time.

Numerous tools, both manual and powered, have been developed to grasp and hold the thin, commercially available sandpaper such as powered orbital sanders and hand held sanding blocks. The power sanders typically require a certain width or size of sandpaper and intricate folding or manipulation of the outer edges under strong spring clips which grasp and hold the edges of the sandpaper. The process to remove and install sandpaper on powered sandpaper is difficult and time consuming to properly align and hold the sandpaper in proper relationship to the powered or moving surface of the tool. It commonly takes in upwards of one minute or longer to secure a new piece of sandpaper to the powered sander.

Hand held sanding tools suffer from similar disadvantages. Sanding blocks known in the art require difficult manipulation of the sandpaper around one or more edges of the block and use clamps or barbs to pierce the sandpaper to hold it in place. Piercing the sandpaper with the barbs requires forced placement of the user's fingers in close proximity to the barbs increasing the chances of injury. Commercially available sanding blocks are bulky and further are made from dense materials which are heavy and would be lost if dropped in water for example, in a marine environment.

Thus it would be desirable to provide an abrasive sheet that has a supportive backing structure to improve on the disadvantages in common sandpaper and like media. It is further desirable to provide an abrasive sheet that is easy and comfortable to grasp, that maintains the integrity of the abrasive surface under force or environmental exposure, that is easily cut to a desired shape or configuration, that is water resistant and does not roll-up or curl when exposed to moisture, and that is simple and inexpensive to manufacture.

It is further desirable to provide an abrasive sheet that is easily usable and adaptable to hand tools and hand-operated power tools that requires only a few seconds to remove a used abrasive sheet with new or alternate abrasive sheet.

SUMMARY OF THE INVENTION

The inventive abrasive sheet includes a abrasive media that is mounted to a support member through a bond layer forming a one-piece abrasive sheet. The inventive abrasive sheet fully supports the abrasive media and is easily die-cut or manually cut to any desired shape suitable for the particular application. The abrasive sheet is light weight, will not lose its shape when exposed to moisture or force, and is relatively soft enabling a comfortable, positive grip.

In a preferred aspect of the abrasive sheet, a polymeric foam support member having a thickness of about one-quarter (¼) inch to one (1) inch thick and a density of about 1.5 to 10 pounds per cubic foot is bonded to an abrasive media through a bond layer. In alternate aspects, foam materials such as polyethylene, ethylene vinyl acetate or neoprene may be used.

In a preferred aspect of the abrasive sheet, the sheet is singularly used without an independent holder or other tool.

In an alternate aspect, the abrasive sheet is removeably mounted to a holder having peripheral walls or pins for frictional engagement with the support member to hold the abrasive sheet to the holder. The holder may itself be adaptable or mounted to a hand-held power or manually-operated tool or maybe integral with the tool itself

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
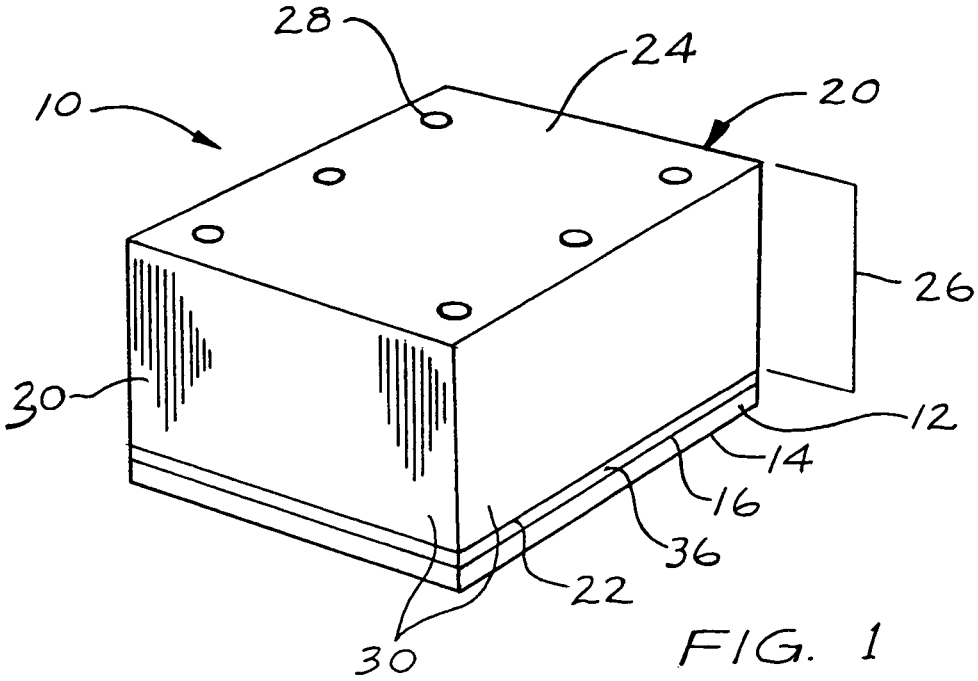
FIG. 1 is a perspective view of the abrasive sheet of the present invention.

Referring to FIGS. 1–8, an abrasive sheet 10 of the present invention is illustrated. The abrasive sheet is useful for sanding or polishing the surfaces of materials.

Abrasive sheet 10 includes an abrasive media 12 having an abrasive surface 14 and an opposing surface 16. In a preferred aspect, abrasive media 12 is a standard sheet of sandpaper commercially available in grits ranging from 80 (course) to 2,000 (super fine) having a paper backing of A or C weight. Standard 9 inch wide by 11 inch long sandpaper sheet is preferably used although other sizes and shapes are equally usable. 3M brand sandpaper having the capability of use in wet or dry sanding has been found to be suitable as abrasive media 12. It is understood that sandpaper of different sizes, grits, weights and compositions as well as other commercially available abrasive or polishing media that is bonded to or includes a backing to which the abrasive material is imbedded or mounted to may be used without deviating from the present invention.

Referring to FIG. 1, abrasive sheet 10 includes a support member 20 having a first surface 22 and an opposing second surface 24 defining a thickness 26 of the support. Support 20 further includes peripheral surfaces 30. Support 20 is preferably made from a polymeric foam having a material density of 1.5 to 10 pounds per cubic foot although densities above and below this range may be used. A suitable polymeric foam is closed-cell, cross-linked polyethylene foam marketed as MINICEL M200 and M300 having general properties identified in table 1 below. In an alternate aspect, support 20 is made from an ethylene vinyl acetate (EVA) polymeric foam. Suitable cross-linked, closed-cell EVAs include EVA 200G and EVERLASTIC EVA 400G distributed by Williams Products, Inc of Troy, Mich. having the general properties listed in tables 2 and 3 below. In an alternate aspect, support 20 is made from neoprene foam. Suitable neoprene polymeric foams include EVERLASTIC closed-cell neoprene types NN-1, NN-2 and NN-3 distributed by Williams Products, Inc. having the general properties listed in table 4 below.

In an alternate aspect, support 20 is made from a multilayer structure, for example, a two layer foam structure including a first layer and a second layer mounted to the first layer through a separate bond layer, for example, adhesive (not shown). The first layer can be made from a different material or exhibit different physical properties than the second layer to suit the particular application.

Although cross-linked, closed-cell, polyethylene, EVA and neoprene polymeric foams are disclosed, other types of foam, for example expanded polystyrene, or foams that include one or more of the disclosed foams may be used that exhibit good abrasion and wear characteristics, that are compressible, that are easily cut using cutting dies or hand tools, that are heat resistant and that are water resistant and preferably buoyant are useable without deviating from the present invention.

TABLE 1

Minicel M300 Typical Properties

| Property | M200 | M300 |
|---|---|---|
| Density Range, pcf (ASTM D3575-84) | 1.5–2.5 | 2.4–3.5 |
| Compression Strength, psi (ASTM D3575) | | |
| @ 25% deflection | 6–11 | 12–22 |
| @ 50% deflection | 12–22 | 20–34 |
| Compression Set % of original thickness (ASTM D3575-84) | 22 maximum | 17 maximum |
| Tensile Strength, psi (ASTM D3575-84) | 30–60 | 55–120 |
| Elongation To Break (%) (ASTM D3575-84) | 75–140 | 110–160 |
| Tear Resistance, lbs/inch (ASTM D3575-84) | 5–12 | 8–21 |
| Thermal Stability, % shrinkage 3 hours | | |
| @ 180° F. | 2.0 | 1.4 |
| @ 215° F. | 4.1 | 3.5 |

TABLE 1-continued

Minicel M300 Typical Properties

| Property | M200 | M300 |
|---|---|---|
| Temperature Range Degrees F. | (−110)–+230 | (−110)–+230 |

TABLE 2

EVA 200G Typical Physical Properties

| Property | Test Method | Typical Values |
|---|---|---|
| Density (lbs/cu. Ft.) | ASTM D 3575-91 | 2.3 ± 0.5 |
| Compression/Deflection (psi Required to compress to 25%) | ASTM D 1056-91 | 5 ± 2 |
| Compression | ASTM D 1752-84 Modified | 14.5 psi |
| Recovery @ 50% | (10 psi. Min. to 25 psi. Max.) | 99% |
| Extrusion @ 50% | | 0.10 inch |
| Ultimate Tensile Strength | ASTM D 3575-91 | 50 psi |
| Water Absorption | ASTM D 1056-91 | <5% (max. gain by weight) |
| Odor | | No Objectionable Odor |
| K Factor | | 0.25 |
| Service Temperature | | |
| Low | | −70° F. |
| High Continuous | | 160° F. |
| High Intermittent | | 180° F. |
| Flame Resistance | MVSS-302 | PASS |
| Accelerated Aging (7 Days) 158° Flexibility | | |
| 180° Bend Without Cracking | | Pass |
| Appearance Change in | | None |
| Compression/Deflection | | ±30 |

TABLE 3

EVERLASTIC EVA 400G Typical Physical Properties

| Property | Test Method | Typical Values |
|---|---|---|
| Density (lbs/cu. Ft.) | ASTM D 3575-91 | 4 ± 0.7 |
| Compression Deflection 25% | ASTM D 1056-91 | 9 ± 2 |
| Elongation | | 200% Typical |
| Extrusion @ 50% | (see note 1) | 0.10 inch |
| Ultimate Tensile Strength | ASTM D 3575-91 | 80 psi |
| Water Absorption | ASTM D 1056-91 | 5% max. gained by weight |
| Odor | | No Objectionable Odor |
| K Factor | | 0.30 |
| Service Temperature | ASTM D-746 | |
| Low | | −100° F. |
| High Continuous | | 160° F. |
| High Intermittent | | 180° F. |
| Flame Resistance | MVSS-302 | Pass |
| Accelerated Aging (7 days @ 158° F.) | | |
| 180° Bend Without Cracking | | Pass |
| Appearance Change | | None |
| Change Compression/Deflection | | ±30% |

TABLE 4

EVERLASTIC Closed Cell Neoprene Typical Physical Properties

| Product Designation | | 1040 NN-1 | 1050 NN-2 | 1060 NN-3 |
|---|---|---|---|---|
| ASTM Designation: | D 1056-68 | SCE-41 | SCE-42 | SCE-43 |
| | D 1056-78 | RE-41 | RE-42 | RE-43 |
| | D 1056-85 | 2A1/2C1 | 2A2 | 2A3 |
| MIL R-6130 C | Type/Grade | II-A | II-A | II-A |
| | Condition | Soft | Soft–Medium | Medium |
| Physical Properties: | Color | Black (Gray) | Black (Gray) | Black (Gray) |
| Compression-Deflection 25% defl. (psi)(kN/m) | | 2–5 (14–35) | 5–9 (35–63) | 9–13 (63–91) |
| Ultimate Tensile Strength | | 75 psi. | 100 psi. | 100 psi. |
| Elongation: | Physical Properties % | 175% | 175% | 200% |
| Density: | lb/ft | 6 ± 2 .10 ± 03 | 7 ± 2 .11 ± 03 | 10 ± 2 .16 ± 03 |
| Fluid Immersion: Ref. Fuel B, weight change max. % | 7 days @ 73° F. | 5% | 5% | 5% |
| Accelerated Aging: 7 days @ 73° F. | | | | |
| Flexibility: 180° bend without cracking | | Pass | Pass | Pass |
| Appearance Change | | None | None | None |
| Change in compression-deflection | | ±30% | ±30% | ±30% |
| Maximum Weight % | | 5 | 5 | 5 |
| Service Temperature | Low | −40° F. | −40° F. | −40° F. |
| | High Continuous | 200° F. | 200° F. | 200° F. |
| | High Intermittent | 250° F. | 250° F. | 250° F. |

A plurality of apertures 28 (six shown) may be die cut in and through abrasive sheet 10 for various applications as needed, for example, in use with power orbital sanders as described below. In applications where apertures 28 are die cut through abrasive sheet 10, support member 20 densities ranging from 2.8 to 6.0 pounds per cubic foot are most preferred. It is understood that densities outside this range may be used without deviating from the present invention.

The thickness 26 of support 20 ranges from one-quarter (¼) inch to one (1) inch thick depending on the application, although thickness outside this range may be used. In the present invention, abrasive sheet 10 can be cut to a small width, for example, down to an eight (⅛) inch for use is small cracks or crevices where little clearance is available or small details require material removal or polishing. In a preferred aspect, support 20 is initially 9 inches wide by 11 inches long to approximate the size of the standard size abrasive media 12 sheet. The foam support 20 is easily die cut or hand cut to the size needed in the densities and thicknesses disclosed.

Abrasive sheet 10 further includes a bond layer 36 positioned between abrasive media 12 and support 20. Bond layer 36 bonds or mounts abrasive media 12 to support 20. Bond layer 36 is preferably an adhesive positioned or applied between first surface 22 of support 20 and opposing surface 16 of abrasive media 12 forming a bond therebetween (bond layer 36 enlarged in figures for ease of illustration only). A suitable adhesive for bond layer 36 for use with the preferred 3M brand abrasive media 12 is 3M brand Super 77 spray-on adhesive. It has been determined that a spray-on adhesive applied to substantially all of both surfaces 16 and 22 provides good adhesion of abrasive media 12 to support 20 on the application of pressure. Other means for fastening or types of adhesives may be used, for example, double-sided adhesive tape, transfer adhesive, contact cement, recessed common fasteners and the like. Different methods of application of the adhesive, such as brush-on adhesives, are also suitable, but less preferred. In a preferred aspect, bond layer 36 maintains its adhesion properties when exposed to moisture or directly to water.

Bond layer 36 along with support 20 is effective in maintaining the form of abrasive surface 14 on exertion of compressive forces to support 20 or abrasive media 12 without folding or wrinkling of abrasive media 12 and abrasive surface 14. Bond layer 36 further provides additional structure to abrasive sheet 10 as well as a barrier between abrasive media 12 and support 20 to deter or prevent passage of fluids, for example, water or energy in the form of heat or cold passing through to support 20 or abrasive sheet 12.

Figure 5:
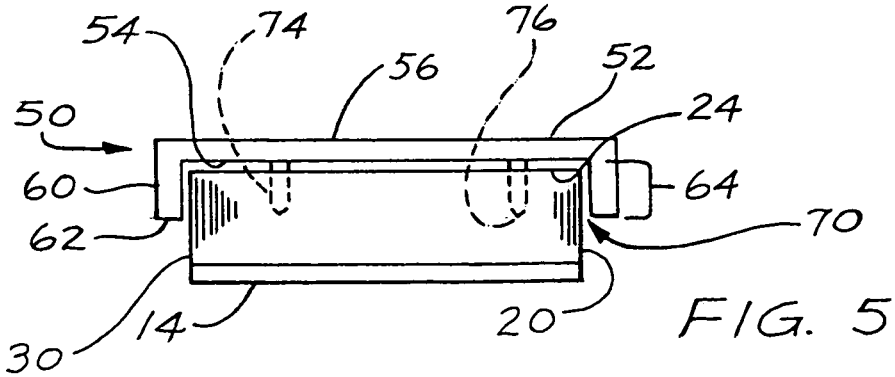
FIG. 5 is a cut-away elevational view of the abrasive sheet mounted in the holder of FIG. 2.
Figure 2:
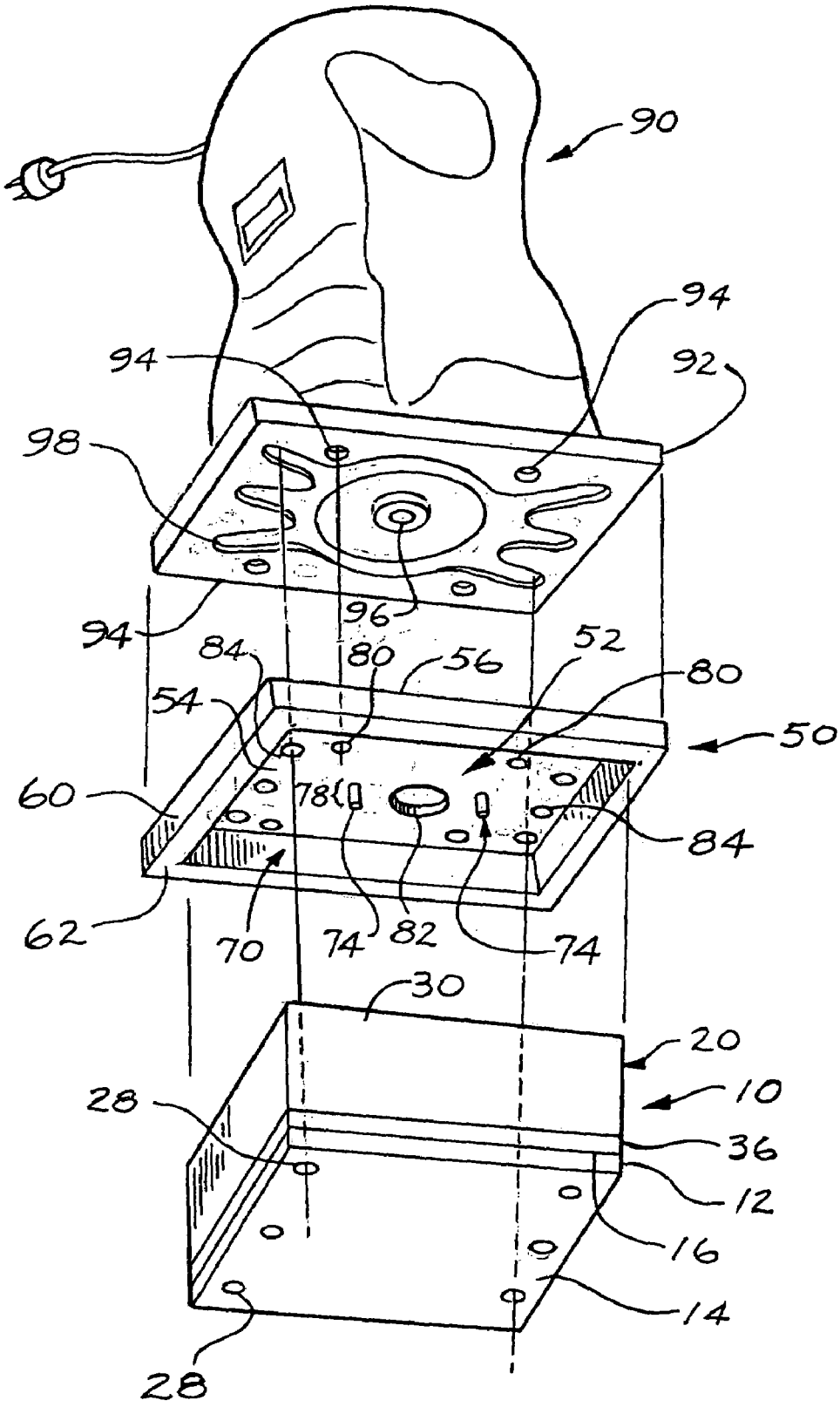
FIG. 2 is an exploded perspective view of the abrasive sheet in use with a holder and a powered orbital sander.
Figure 3:
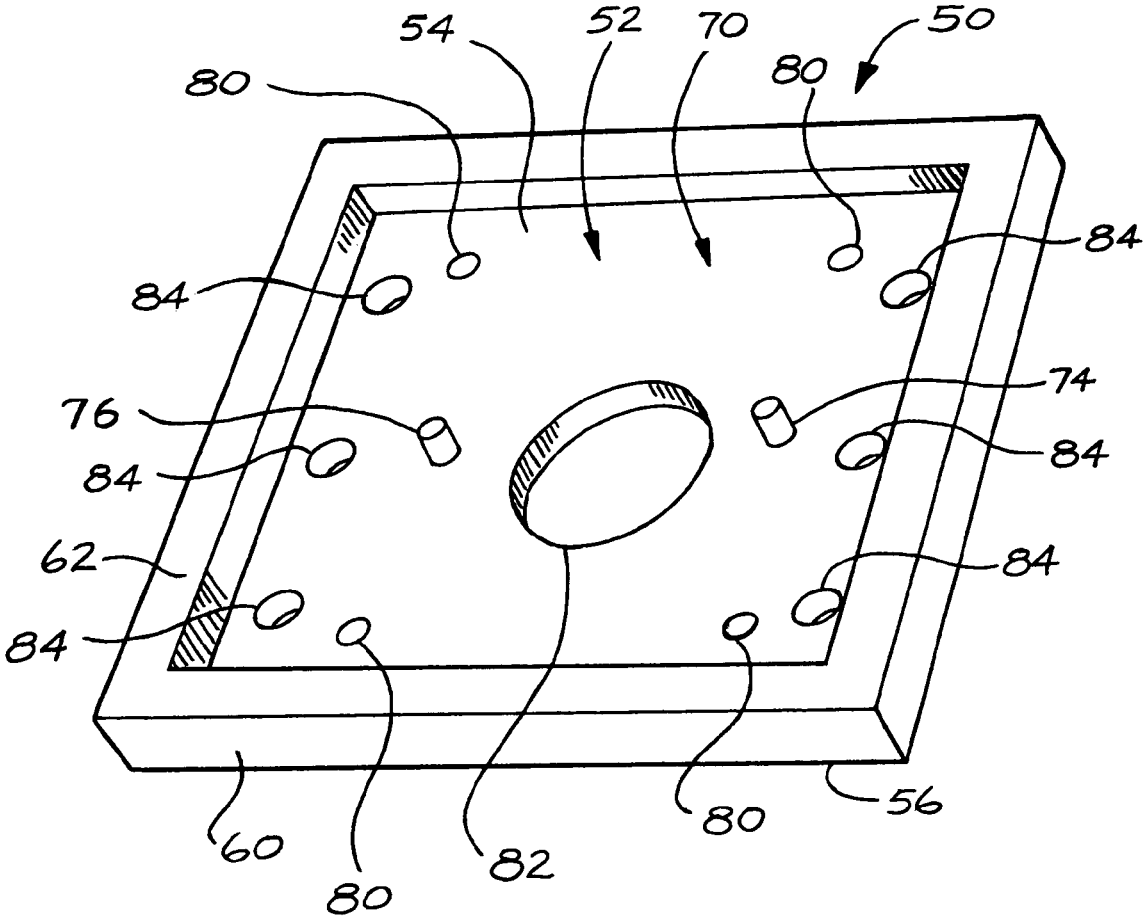
FIG. 3 is a perspective view of a holder for use with the abrasive sheet.

Referring to FIGS. 2 and 3, an alternate application of abrasive sheet 10 is illustrated. As shown, abrasive sheet 10 is used with a holder 50. Holder 50 includes a base 52 having a first surface 54 and a second opposing surface 56. First surface 54 is substantially planar to second surface 24 of support 20. As shown in FIGS. 2 and 5, holder 50 further includes peripheral walls 60 having a peripheral rim 62 defining a height 64 of peripheral walls 60 between first surface 54 and peripheral rim 62 as best seen in FIG. 5. Peripheral walls 60 and first surface 54 of base 52 define a cavity 70 in holder 50 for receiving abrasive sheet 10.

As shown in FIGS. 2, 3 and 5, base 52 preferably includes a plurality of holding pins 74 (two shown) extending from first surface 54 into cavity 70. Holding pins 74 are preferably cylindrically-shaped with a blunt distal end 76 defining a pin length 78. In a preferred aspect, length 78 of pins 74 is approximately ⅛ inch below peripheral rim 62 as best seen in FIG. 5. Pins 74 are preferably integrally molded into base 52, but may be separately inserted through second surface 56 and secured to base 52. In an alternate aspect, pins 74 extend outwardly from peripherals sidewalls 60 into cavity 70 (not shown). It is understood that fewer or more pins 74 may be used to suit the particular application and may be eliminated altogether depending on the configuration of the holder 50.

Figure 7:
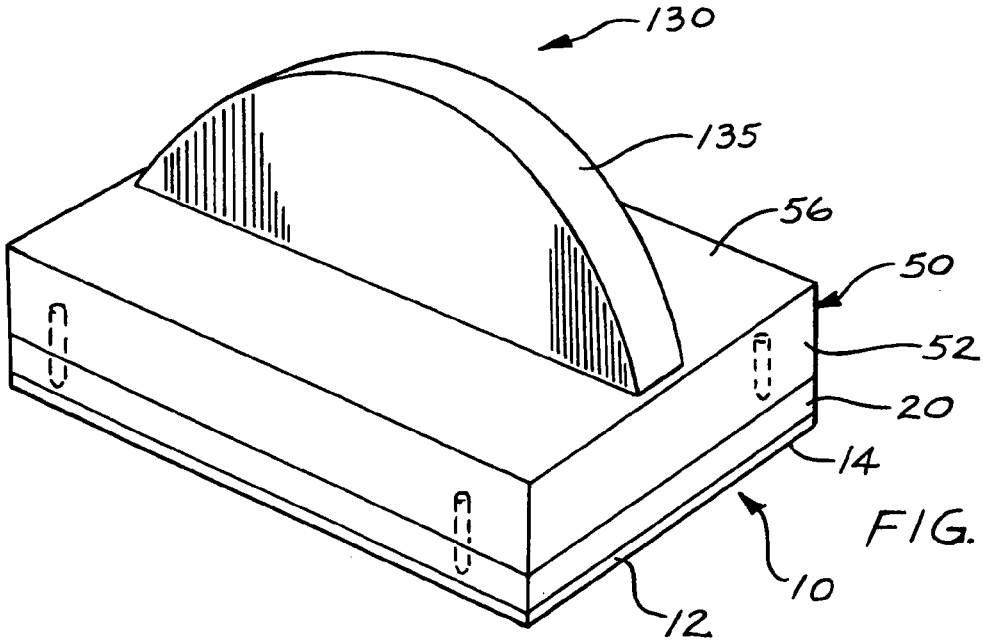
FIG. 7 is perspective view of the abrasive sheet mounted on an alternate hand tool.
Figure 8:
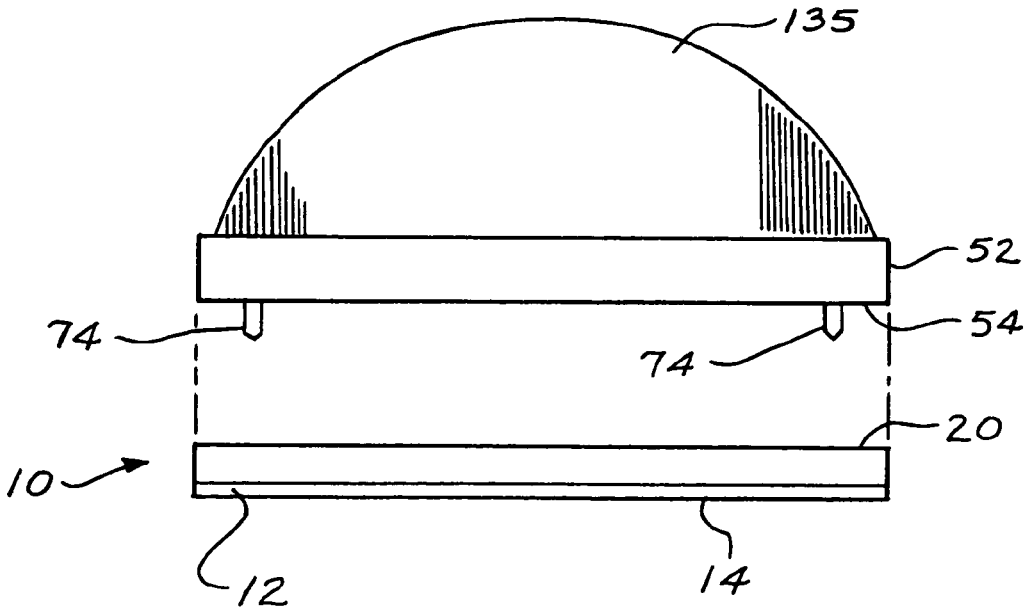
FIG. 8 is an exploded elevational view of the abrasive sheet for use with the hand tool in FIG. 7.

Referring to FIGS. 7 and 8, an alternate holder for use with a hand tool is illustrated. In this aspect, holder 50 includes base 52, first surface 54, second surface 56 and pins 74 without peripheral walls 60.

Referring to FIG. 3, holder 50 includes a plurality of apertures 80 positioned about base 52 for attachment of holder 50 to an additional device or tool for example, an orbital sander 90 as best seen in FIG. 2. Base 50 further includes a plurality of vacuum apertures 84 for use with air-vacuum features common in powered sanding tools, for example, the orbital sander 90. The number and position of vacuum apertures 84 on base 52 are dependent on the corresponding vacuum inlets or features 98 in the corresponding tool and are preferably positioned in axial alignment therewith. Corresponding, axially aligned apertures 28 may be die cut through abrasive sheet 10 as illustrated in FIGS. 1 and 2. Base 52 further includes a clearance aperture 82 positioned at the approximate center of holder 50 and provides clearance for parts on the orbital sander 90 and to reduce weight and use of material in manufacturing.

Holder 50 is preferably made from a moldable polymer or elastomer that has good wear and tensile strength characteristics. It has been determined that the elastomer VITRON is a suitable material for holder 50. Styrene butadiene rubber (SBR) has also has been determined to be a suitable material. It is understood that other materials including polymeric as well as ferrous and non ferrous materials, for example aluminum, having good wear and tensile strength characteristics may also be used without deviating from the present invention.

Figure 4:
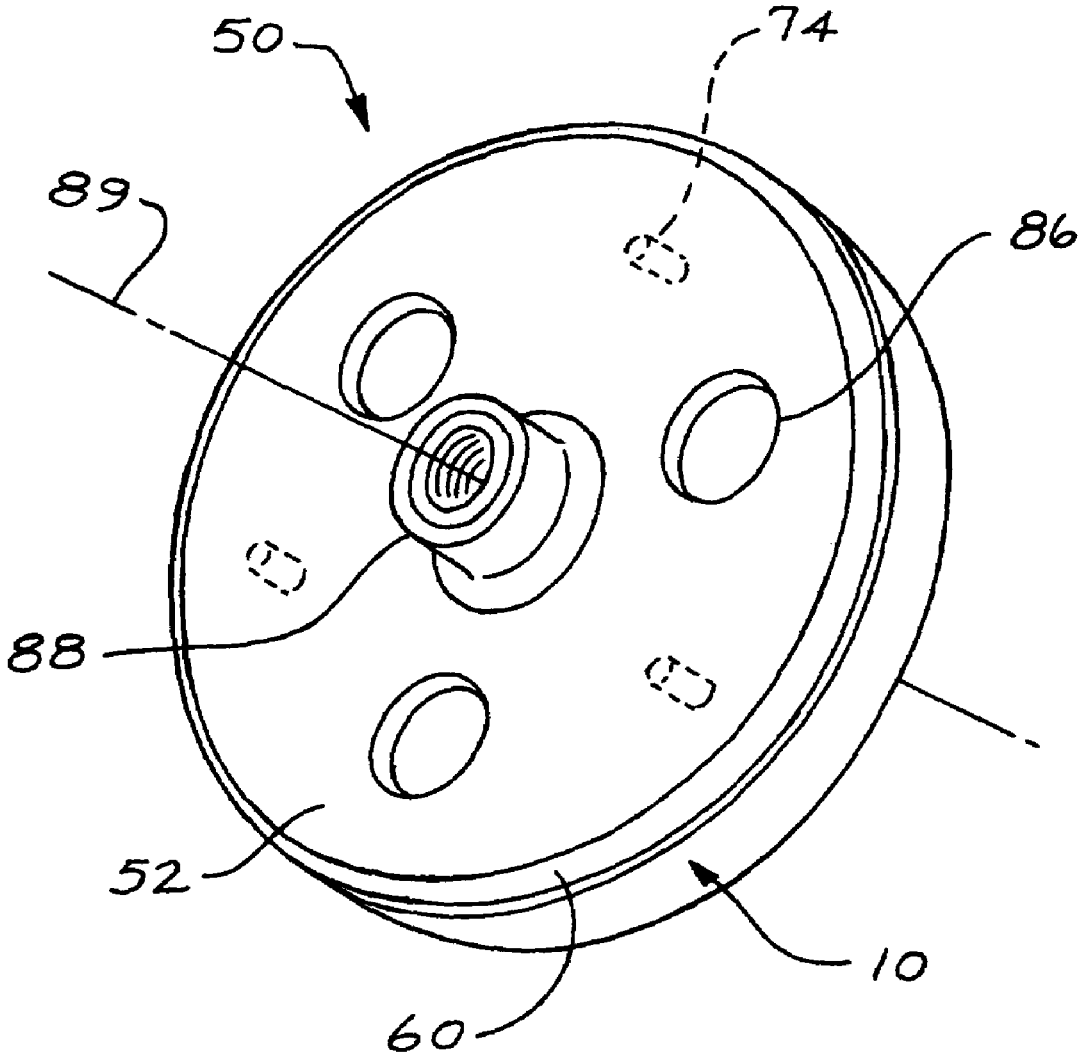
FIG. 4 is a perspective view of an alternate holder for use with the abrasive sheet.

Referring to FIG. 4, an alternate holder 50 is illustrated. In this aspect, the holder 50 is generally circular-shaped having a base 52, peripheral walls 60 and peripheral rim 62 (not shown). The circular holder 50 includes a plurality of holding pins 74 (three shown) that similarly extend into cavity 70 (not shown) as described for alternate holder 50 shown in FIGS. 3 and 4. The circular holder 50 shown in FIG. 4 further includes a plurality of access apertures 86 (three shown) positioned about base 52. Access apertures 86 are sized to permit human fingers to pass through to dislodge and eject abrasive sheet 10 when mounted in holder 50. Access apertures 86 are also useful to reduce weight and material usage and to assist in air cooling the holder 50 and abrasive sheet 10 due to frictional forces generated while the abrasive sheet and holder are in use.

Alternate holder 50 shown in FIG. 4 further includes an attachment receptacle 88 in the form of a threaded boss for threading engagement to an additional tool, for example, a hand-held rotating sander or surface grinder (not shown) and is positioned along an axis 89 for rotation of holder 50 and abrasive sheet 10 thereabout. The alternate holder 50 is preferably made from the materials previously described for the holder 50 shown and described.

In operation, on the mounting of abrasive media 12 to support 20 through bond layer 36, a firm, yet flexible apparatus having an abrasive surface 14 for use in sanding or polishing the surface of materials is created. In this state, the otherwise limp abrasive media 12 is firmly supported by the bond layer 36 and support 20 such that no buckling or unwanted folding of the abrasive media 12 occurs unlike a common sheet of sandpaper. The abrasive media 12 further does not curl or roll-up when exposed to moisture or water over time. The abrasive sheet 10 is easily die cut to a desired size, including any internal apertures 28, for example, vacuum apertures, by inexpensive die cutting equipment, or manually cut by the end user to the size or shape needed for particular applications. Although the abrasive media 12 is shown on a single first surface 22, abrasive media 12 may be mounted to an alternate or plurality of sides to suit the particular application.

The support 20, when manufactured from the preferred polymeric foam materials, further provides firm, yet cushioning surfaces which are easily grasped by and are comfortable to the hand. Support 20 and bond layer 36 provide sufficient structural support to maintain its shape during use with only a user's hand or with other tools such as orbital sander 90 when mounted in holder 50. Support 20 further provides insulating properties from heat generated between abrasive media 12 and the materials being sanded or polished (not shown). The foam support 20 can be molded in different colors to distinguish the different grits or properties of the abrasive media 12 and in the preferred densities, exhibits excellent floatation properties in water. In applications where the abrasive sheet 10 is used with the bare hand, support 20 most preferably has a density of 1.5 to 2.5 pounds per cubic foot. It is understood that densities outside this range may be used without deviating from the present invention.

A preferred application of abrasive sheet 10 is use with commercially available powered sanding equipment, for example, orbital sander 90 as shown in FIG. 2. In this application, orbital sander 90 includes a mounting plate 92 having threaded bores 94 and a rotating spindle 96 causing the orbital action of the sander. Commercial sanders 90 may further include vacuum apertures or features 98 to remove and collect particles removed from the object being sanded or polished (not shown). In a preferred aspect, the sheet holder 50 includes attachment apertures 80 in axial alignment with threaded bores 94 for quick and easy attachment of holder 50 to mounting plate 92 through common fasteners (not shown). As illustrated in FIGS. 1 and 3, holder 50 and support 20 also include apertures 28 and 84 in axial alignment with sander vacuum apertures 98 for cut particles to pass through support 20 and holder 50 to the sander dust collection bag or away from the material work surface.

An abrasive sheet 10 is precut and presized so that peripheral surfaces 30 of support 20 are slightly smaller in length than peripheral walls 60 of holder 50 such that abrasive sheet 10 can be axially positioned in cavity 70 with frictional engagement between peripheral surfaces 30 and peripheral walls 60 as best seen in FIG. 5 (dimensional gap shown between peripheral surfaces 30, peripheral walls 60, second surface 24, and first surface 54 for ease of illustration only). It has been determined that in many applications, the frictional engagement between peripheral surfaces 30 and peripheral walls 60 is sufficient to restrain abrasive sheet 10 in holder 50 during vigorous use in sanding or polishing without the need for holding pins 74. Depending on the application, one or more of the peripheral walls 60 may be eliminated while maintaining adequate engagement of abrasive sheet 10. Similarly, pins 74, alone or in combination with peripheral walls or other formations in holder 50, may be used. In a most preferred aspect in use with a power sander, support 20 has a density of six (6) to eight (8) pounds per cubic foot. It is understood that densities outside this range may be used without deviating from the present invention.

In a preferred aspect, on axial insertion of abrasive sheet 10 into cavity 70, holding pins 78 pierce through second surface 54 of support 20 and protrude into support 20 to further frictionally engage abrasive sheet 10 to holder 50 as best seen in FIG. 5. To increase the frictional engagement of holding pins 74 to the support 20, the pins 74 may be pointed to ease entry into support 20 and may include serrations or other surfaces features or treatments that increase the engagement of pins 74 to support 20. Although holder 50 is illustrated with four peripheral walls 60 around the full perimeter of base 52, it has been determined that in some applications, use of a plurality of holding pins 74 permits one or all of peripheral walls 60 to be eliminated while maintaining sufficient engagement between abrasive sheet 10 and holder 50. See for example FIGS. 7 and 8.

Once abrasive sheet 10 is press-fit and frictionally secured to holder 50, sanding or polishing of a material surface can commence. On a need to change the abrasive media 12, for example, to change the grit or replace it due to wear, the user simply grasps the portion of abrasive sheet 10 exposed above peripheral walls 60 and axially pulls abrasive sheet 10 from holder 50. A different or replacement abrasive sheet 10 is axially inserted into cavity 70 or simply onto holder 50 for additional sanding or polishing. It has been determined that changing the abrasive sheet 10 in holder 50 as shown and illustrated takes only about 3 to 4 seconds greatly reducing tool downtime and increasing productivity.

Figure 6:
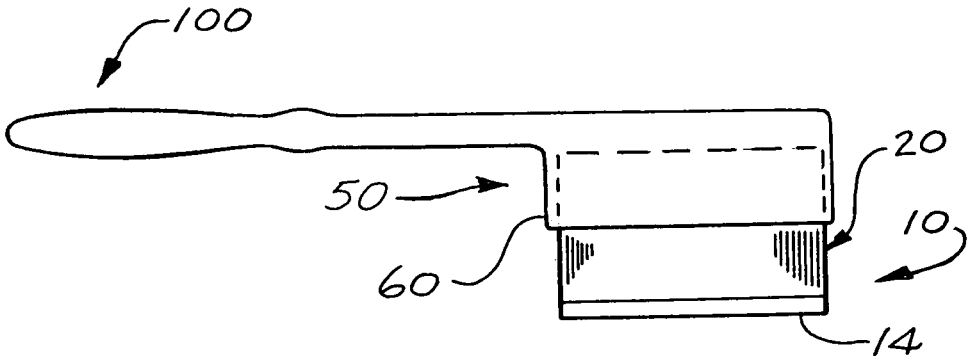
FIG. 6 is a schematic side elevational view of the abrasive sheet mounted in a hand tool.

Referring to FIG. 6, an additional application of abrasive sheet 10 is illustrated. Abrasive sheet 10 is positioned in a hand-held tool 100 having peripheral walls 60 effectively serving as a holder 50 to frictionally engage abrasive sheet 10 axially positioned in cavity 70 (not shown). As illustrated and described above, holding pins 74 may equally be used in addition to or as a replacement for peripheral walls 60 to firmly secure abrasive sheet 10 to hand tool 100. Hand tool 100 may be made from commercially available materials including wood, polymers, elastomers as well as ferrous and nonferrous metals and may take other forms to suit the particular application. In a most preferred aspect in use with a hand tool as described, support 20 has a density of 2.5 to 6 pounds per cubic foot. It is understood that densities outside this range may be used without deviating from the present invention.

Referring to FIGS. 7 and 8, an alternate hand tool 130 is illustrated. In this aspect, hand tool 130 includes a holder 50 without peripherical walls 60. A plurality of pins 74 (four shown) are used to secure support 20 to holder first surface 54. Although support 20 and abrasive media 12 are shown to not extend beyond the outer periphery of holder 50, it is understood that it can to suit the particular application or may simply be repositioned in an offset orientation with respect to holder 50 to facilitate proper positioning of abrasive media 12 in the desired location, for example, in the interior corner of the room wall to ceiling joint. Such repositioning of support 20 with respect to holder 50 can be accomplished in just a few seconds.

Hand tool 130 further includes a handle 135 mounted to second surface 56 shown in FIG. 7. Handle 135 is preferably made from a closed cell neoprene foam, for example, EVERPLASTIC closed cell neoprene sponge PP293 Penn Dot distributed by Williams Products, Inc. It is understood that other materials such as wood, polymers, other elastomers or ferrous and non ferrous materials may be used. Although shown in a rounded configuration, handle 135 can take many forms, for example, a receptacle for use with an extendible, hand-held pole or rod. In a most preferred aspect in use with a hand tool shown in FIG. 7, support 20 has a density of 2.5 to 6 pounds per cubic foot. It is understood that other densities may be used without deviating from the present invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope to be accorded the broadest interpretation so as to encompass all such modifications and equivalent structures as is permitted under the law.

What is claimed is:

1. An abrasive sheet comprising:

a holder having a base including a first surface and at least one of a pin and a peripheral wall extending outwardly from the first surface;

an abrasive media having an abrasive surface; and a polymeric foam support member mounted to the abrasive media having a peripheral surface, the support member is removeably engageable with the holder to secure the support member and abrasive media to the holder, the at least one of a peripheral wall frictionally engaging the peripheral surface of the support member for the sole attachment of the abrasive media to the holder.

* * * * *